United States Patent [19]

Odermann

[11] 4,275,939

[45] Jun. 30, 1981

[54] SEWING MACHINE POSITIONING PIN

[75] Inventor: Charles R. Odermann, Montville, N.J.

[73] Assignee: The Singer Company, Stamford, Conn.

[21] Appl. No.: 935,228

[22] Filed: Aug. 21, 1978

[51] Int. Cl.[3] ..... A47B 21/00

[52] U.S. Cl. ..... 312/208; 248/558; 248/680

[58] Field of Search ..... 248/310, 314, 544, 558, 248/680, 681, 518, 532, 545, 678, 679; 403/3, 13, 292, 296; 312/208, 21

[56] References Cited

U.S. PATENT DOCUMENTS

| | | | |
|---|---|---|---|
| 504,781 | 9/1893 | Hight | 403/292 |
| 1,450,183 | 4/1923 | Moon | 248/680 |
| 1,806,295 | 5/1931 | Kinnard | 248/27.1 |
| 1,948,193 | 2/1934 | Thompson | 248/635 |
| 2,532,767 | 12/1950 | Galkin | 248/635 |
| 2,750,709 | 6/1956 | Saverino | 248/188.2 |
| 2,829,396 | 4/1958 | Kishibay | 248/635 X |
| 2,874,014 | 2/1959 | Perrinjaquet | 312/30 |
| 3,031,796 | 5/1962 | Bruscaglioni | 312/30 |
| 3,111,918 | 11/1963 | Marforio | 112/16 |
| 3,606,410 | 9/1971 | Inserra | 403/13 |
| 3,628,816 | 12/1971 | Ross | 403/13 X |
| 3,866,553 | 2/1975 | Adams | 112/258 |

FOREIGN PATENT DOCUMENTS

| | | | |
|---|---|---|---|
| 1426643 | 12/1965 | France | 403/292 |

*Primary Examiner*—William H. Schultz

*Attorney, Agent, or Firm*—James M. Trygg; Robert E. Smith; Edward L. Bell

[57] ABSTRACT

A positioning pin which permits a sewing machine cabinet to be adapted to accommodate a variety of sewing machines. The positioning pin has a flange dividing the pin into two unequal lengths. The positioning pins are received by bores formed in the base of the sewing machine and the cabinet work surface to properly locate the sewing machine with respect to the work surface. The pins may be reversed end-for-end to adapt to sewing machines having bases with differing heights.

2 Claims, 5 Drawing Figures

SEWING MACHINE POSITIONING PIN

DESCRIPTION

BACKGROUND OF THE INVENTION

1. Field of the Invention

This invention relates to sewing machine cabinets in general, and more particularly to cabinets having the ability to interchangeably accomodate more than one model of sewing machine.

2. Description of the Prior Art

Pin members for positioning sewing machines on the support surface of a sewing machine cabinet are known in the prior art. Prior known positioning pins are usually adapted for use with a specific sewing machine and sewing cabinet, and are usually not adaptable to accomodate more than one sewing machine. It is advantageous for a sewing machine manufacturer to be able to supply but one set of positioning pins which will interchangeably accomodate various sewing machine models on a variety of sewing cabinets. To that end, the disclosed positioning pin serves as a useful and advantageous accessory for a manufacturer to supply with his sewing machines and cabinets.

One problem with former sewing machine positioning pins is that they were suitable for use with only one sewing machine model.

Another problem is that some positioning pins were not easily removed from the base of the sewing machine when the machine was removed from the sewing cabinet.

SUMMARY OF THE INVENTION

It is an object of this invention to provide a sewing machine positioning pin which is readily interchangeable among a variety of sewing machines.

Another object is to provide a positioning pin which is easily adjusted to accomodate sewing machine bases having differing heights.

The above objects and other advantages are achieved by a positioning pin having a flange formed intermediate between the two pin extremities. The extremities are tapered to allow the positioning pin to be freely received within bores contained within the sewing machine base and the support surface of the sewing machine cabinet. The positioning pin flange is received by an annular groove formed in the cabinet support surface and supports the pin at an appropriate height above the work surface. The extremity of the positioning pin which resides above the support surface is received within a bore contained in the base of the sewing machine and acts to position the sewing machine with respect to the cabinet support surface. Sewing machine which have varying base heights may be accomodated by reversing the positioning pin end-for-end so that the appropriate pin extremity resides above the cabinet support surface, thereby allowing the pin to be received within the bore contained in the base of the sewing machine.

DESCRIPTION OF THE DRAWINGS

The above and other objects of this invention will be evident from a full and complete understanding of the preferred embodiment which is hereinafter set forth in such detail as to enable those skilled in the art to readily understand the function, operation, construction and advantages of it when read in conjunction with the accompanying drawings in which.

DESCRIPTION OF THE PREFERRED EMBODIMENT

Figure 1:
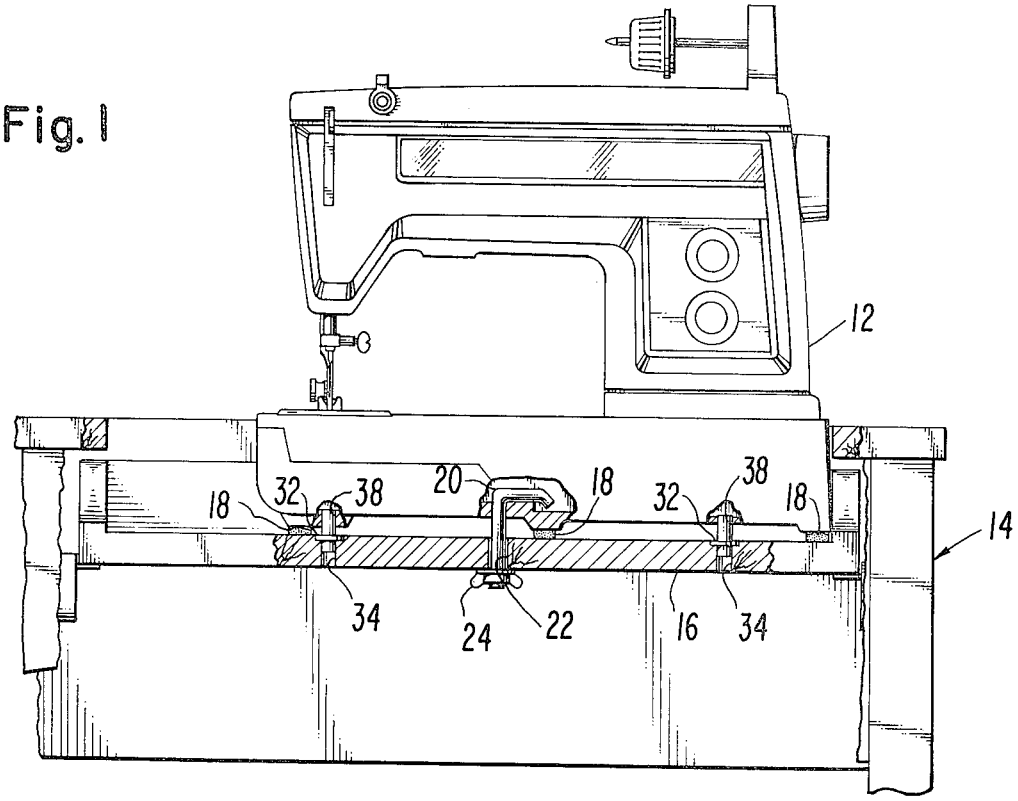
FIG. 1 is a cutaway perspective view of a sewing machine cabinet having a sewing machine positioned thereon with the positioning pins of this invention.

Referring to the drawings, FIG. 1 shows a sewing machine having a base 12 supported within a sewing machine cabinet which is shown generally at 14. The cabinet 14 has a cabinet support surface 16 which supports the sewing machine base 12. Preferably a set of rubber feet 18 are fastened to the base 12 by any convenient means to isolate the transmission of noise from the sewing machine to the cabinet 14. A locking clamp 20 engages an aperture in the base 12 of the sewing machine and passes through a bore 22 in the cabinet support surface 16. Preferably a wing nut 24 engages a set of threads on the locking clamp 20. When tightened, the wing nut 24 snugs the base 12 of the sewing machine against the support surface 16 to minimize the motion of the sewing machine relative to the cabinet support surface 16.

Figure 3:
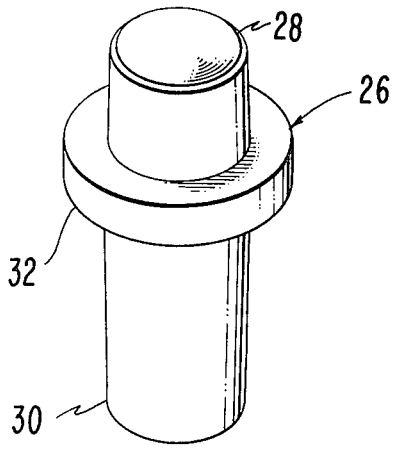
FIG. 3 is a perspective view of the positioning pin of this invention.
Figure 4:
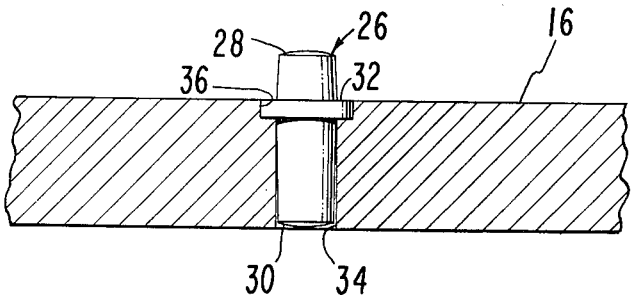
FIG. 4 is a cutaway view of a cabinet support surface showing how the positioning pin resides within a bore in the support surface.
Figure 5:
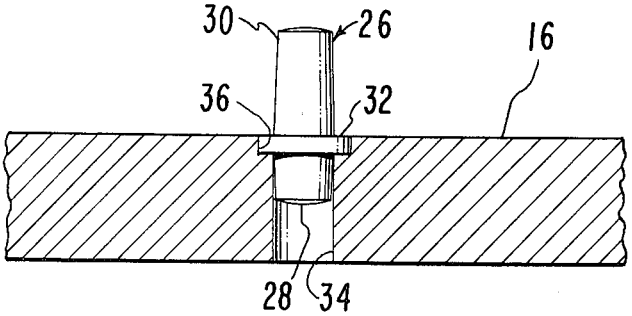
FIG. 5 is a view similar to FIG. 4 showing the positioning pin reversed to expose the longer extremity above the cabinet support surface.

FIG. 3 shows a preferred embodiment of a positioning pin 26 which may be used to locate the sewing machine relative to the cabinet support surface 16. The positioning pin 26 has a tapered first extremity 28 which is shorter than a tapered second extremity 30. An annular flange 32 extends outwardly from the positioning pin 26 and separate the first extremity 28 from the second extremity 30. It will be observed from FIGS. 4 and 5 that the extremities 28 and 30 of the positioning pin 26 are tapered to facilitate their fitting into bores 34 formed on the cabinet support surface 16. It will also be appreciated that concentric with the bore 34, a groove 36 has been formed in the cabinet support surface 16 to receive the flange 32, thereby insuring that the flange 32 remains at all times flush with the cabinet support surface 16.

Figure 2:
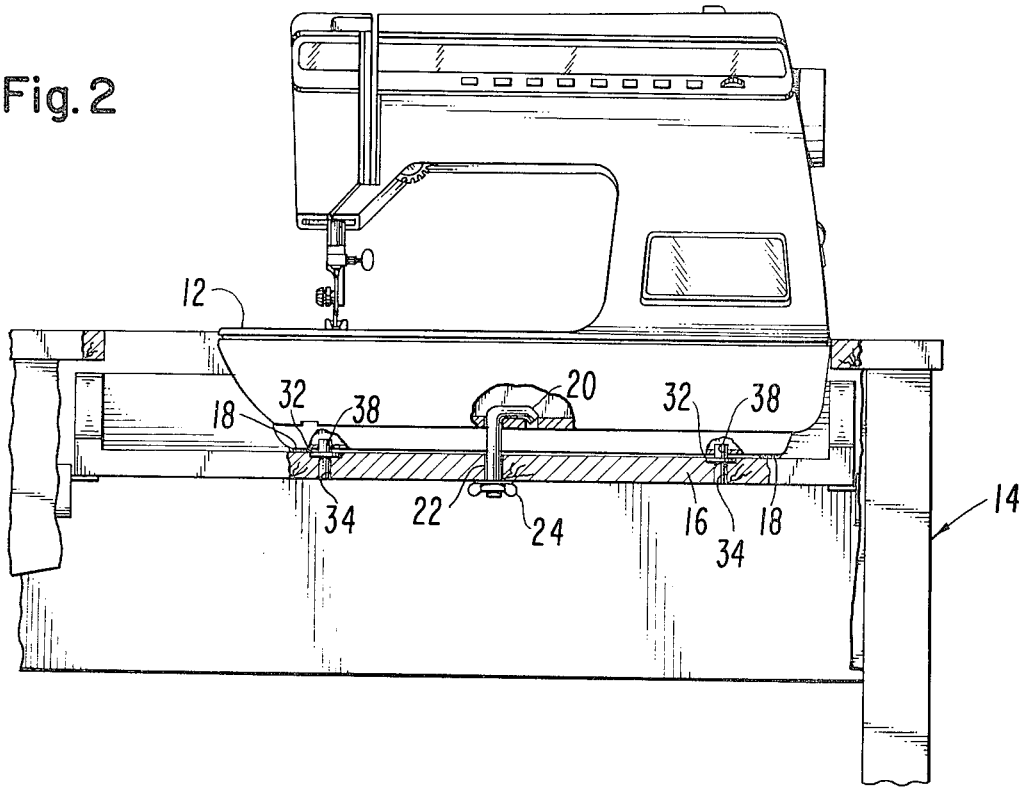
FIG. 2 is a view similar to FIG. 1 showing how a different model sewing machine may be positioned on the cabinet by reversing the positioning pins of FIG. 1.

The use of the disclosed positioning pin 26 in adapting to position different models of sewing machines with respect to the cabinet support surface 16 of a sewing machine cabinet 14 may best be seen by reference to FIGS. 1 and 2 of the drawings. FIG. 1 shows a sewing machine having a base 12 which resides at a greater height above the cabinet support surface 16 than does the base 12 shown in FIG. 2. It will therefore be apparent that the positioning pins 26 are turned so that the longer extremity 30 is above the surface 16. The sewing machine may therefore receive the positioning pins through a set of bores 38 contained in the base 12. The locking clamp 20 may thereafter be used to firmly attach the sewing machine to the cabinet 14. Similarly, it will be apparent that if the sewing machine of FIG. 2 with the lower base height is to be fastened to the cabinet 14, the positioning pins 26 will have to be reversed end-for-end, so that the longer extremity 30 resides in the bores 34 and the shorter extremity 28 is therefore available to be received by the bores 38 contained in the base 12. The height of the positioning pins 26 with respect to the work support surface 16 will not therefore interfere with the rubber feet 18 resting on the cabinet support surface 16.

It will thereby be apparent that owing to the ability to freely reverse the positioning pin 26 with respect to the cabinet support surface 16, the height of the pin 26 above the surface 16 may be changed to accommodate a variety of sewing machines.

It is to be understood that while the preferred embodiment has shown a cylindrical positioning pin, pins of many different shapes may be advantageously employed to perform the same function. For example, positioning pins having a rectangular or hexagonal cross section would also perform the function of the heretofore disclosed positioning pin. It is to be further understood that the shape of the positioning pin disclosed in the preferred embodiment is given for example only, and should not be construed as a limitation on the spirit and scope of the claimed invention.

It will be appreciated that modifications and variations of the described invention may become evident to one skilled in the art in light of the above teachings. It is to be understood that such variations may be made to the preferred embodiment without departing from the spirit and scope of the invention as defined in the appended claims.

I claim:

1. The combination of a sewing machine having stitch forming instrumentalities, a cabinet having a sewing machine support surface, and a positioning pin for locating any one of a variety of said sewing machines with respect to said support surface, said sewing machines having bases of varying heights wherein each base has at least one bore for receiving said positioning pin, said base having feet which rest on said support surface; said support surface also having at least one bore for receiving said positioning pin; said positioning pin comprising a first extremity and a second extremity; a flange intermediate said first and said second extremities; said first extremity being shorter than said second extremity so that said pin may be in either of two positions for accomodating any one of said variety of sewing machines having bases of varying heights.

2. The arrangement as set forth in claim 1 wherein said first and said second extremities are tapered thereby facilitating locating said positioning pin in said bores in said support surface and said sewing machine base.

* * * * *